US008864336B2

(12) United States Patent
Yasuoka

(10) Patent No.: US 8,864,336 B2
(45) Date of Patent: Oct. 21, 2014

(54) LED LIGHT EMITTING APPARATUS

(75) Inventor: Tsuyoshi Yasuoka, Anan (JP)

(73) Assignee: Nichia Corporation, Anan-shi (JP)

( * ) Notice: Subject to any disclaimer, the term of this patent is extended or adjusted under 35 U.S.C. 154(b) by 245 days.

(21) Appl. No.: 13/593,446

(22) Filed: Aug. 23, 2012

(65) Prior Publication Data

US 2013/0051020 A1 Feb. 28, 2013

(30) Foreign Application Priority Data

Aug. 26, 2011 (JP) ..... 2011-184215

(51) Int. Cl.

| | |
|---|---|
| ***F21V 31/00*** | (2006.01) |
| ***F21V 1/14*** | (2006.01) |
| ***F21V 15/01*** | (2006.01) |
| ***B65D 45/10*** | (2006.01) |
| ***F21V 21/00*** | (2006.01) |
| ***F21V 11/02*** | (2006.01) |
| *F21Y 105/00* | (2006.01) |
| *F21Y 101/02* | (2006.01) |

(52) U.S. Cl.

CPC ..... *F21V 21/00* (2013.01); *F21Y 2105/001* (2013.01); *F21V 31/00* (2013.01); *F21V 11/02* (2013.01); *F21Y 2101/02* (2013.01)

USPC ..... 362/267; 362/235; 362/248; 362/362; 362/457; 220/327

(58) Field of Classification Search

USPC ..... 362/235–237, 248, 249.02, 267, 457; 220/235, 236, 327, 328

See application file for complete search history.

(56) References Cited

U.S. PATENT DOCUMENTS

| | | | | |
|---|---|---|---|---|
| 3,018,127 | A * | 1/1962 | Dobrosielski et al. | 292/251 |
| 5,268,828 | A * | 12/1993 | Miura | 362/249.06 |
| 6,669,351 | B1 * | 12/2003 | Shea et al. | 362/153.1 |
| 7,549,772 | B2 * | 6/2009 | Wang | 362/294 |
| 7,637,630 | B2 * | 12/2009 | Wilcox et al. | 362/267 |
| 7,914,183 | B2 * | 3/2011 | Yang et al. | 362/373 |
| 8,162,508 | B2 * | 4/2012 | Murakoshi et al. | 362/249.02 |
| 8,167,468 | B1 * | 5/2012 | Olsson et al. | 362/477 |
| 2012/0140465 | A1 * | 6/2012 | Rowlette et al. | 362/235 |
| 2012/0155080 | A1 * | 6/2012 | Schupple et al. | 362/235 |

FOREIGN PATENT DOCUMENTS

| | | |
|---|---|---|
| JP | 05-47985 U | 6/1993 |
| JP | 06-161360 | 6/1994 |
| JP | 06-188460 | 7/1994 |

* cited by examiner

*Primary Examiner* — Alan Cariaso

(74) *Attorney, Agent, or Firm* — Mori & Ward, LLP

(57) ABSTRACT

An LED light emitting apparatus according to an embodiment of the present invention includes a plurality of LEDs, a case having the LEDs at its front side, and a plurality of bolts each having a threaded portion for fixing the case to outside. The case has a plurality of insertion portions each allows inserting a bolt from the front side through the back side of the case. Each of the insertion portions has at its inner portion an elastic member having a first inner diameter which is smaller than the outer diameter of the threaded portion, and the elastic member is fixed in the insertion portion.

18 Claims, 5 Drawing Sheets

LED LIGHT EMITTING APPARATUS

BACKGROUND OF THE INVENTION

1. Field of the Invention

The present invention relates to an LED light emitting apparatus using LEDs as its light source.

2. Description of the Related Art

Due to reasons such as a lack of working space behind the apparatus, there has been known an LED light emitting apparatus which can be fixed to an outside by using bolts from the front side, i.e. the viewing side.

See Japanese Unexamined Patent Application Publication No. H06-161,360 (1994); Japanese Unexamined Patent Application Publication No. H06-188,460 (1994); and Japanese Unexamined Utility Model Application Publication No. H05-47,985 (1993).

However, various problems may arise at the time of fixing an LED light emitting apparatus by using bolts from the front surface side of the apparatus. An LED light emitting apparatus may be installed at a high place such as a side wall of a building. However, at the time of installation or maintenance, the bolts for fixing the apparatus to the wall may accidentally fall. This may results in injury to a passerby. Also, when it is raining, there is a possibility of, through the through-holes for insertion of the bolts, the rainwater entering the back side of the apparatus which should be kept free from the water. Typically, a control device for the LED light emitting apparatus and a power supply are housed at the back side of the LED light emitting apparatus. Therefore, the ingress of rainwater into such devices may result a malfunction of the LED light emitting apparatus caused by a short circuit or the like.

SUMMARY OF THE INVENTION

An LED light emitting apparatus according to an embodiment of the present invention includes a plurality of LEDs, a case having the LEDs at its front side, and bolts each having a threaded portion for fixing the case to an outside. The case has a plurality of insertion portions each allowing insertion of a bolt from the front side through to the back side of the case. Each of the insertion portions has at its inner portion an elastic member having a first inner diameter smaller than an outer diameter of the threaded portion and being fixed to the insertion portion. The above and further objects of the present invention as well as the features thereof will become more apparent from the following detailed description to be made in conjunction with the accompanying drawings.

DETAILED DESCRIPTION OF THE EMBODIMENT

The embodiments for implementing an LED light emitting apparatus according to the present invention will be described below with reference to the drawings. The preferred embodiments are intended as illustrative of a light emitting apparatus to give a concrete form to technical ideas of the present invention, and the scope of the invention is not limited to those described below. The sizes and the arrangement relationships of the members in each of drawings are occasionally shown exaggerated for ease of explanation.

Figure 1:
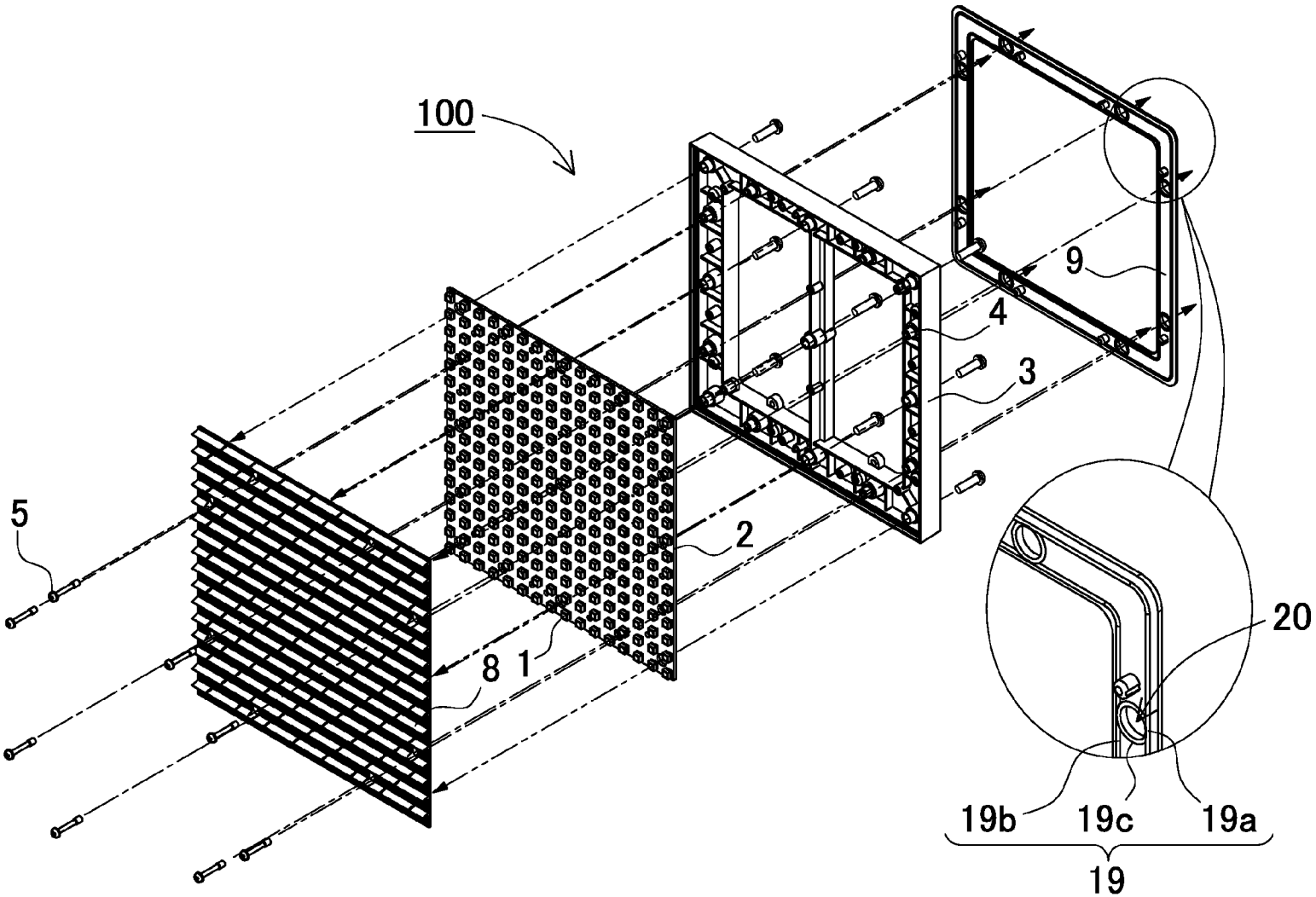
FIG. 1 is an exploded view of an LED light emitting apparatus according to an embodiment of the present invention.
Figure 2:
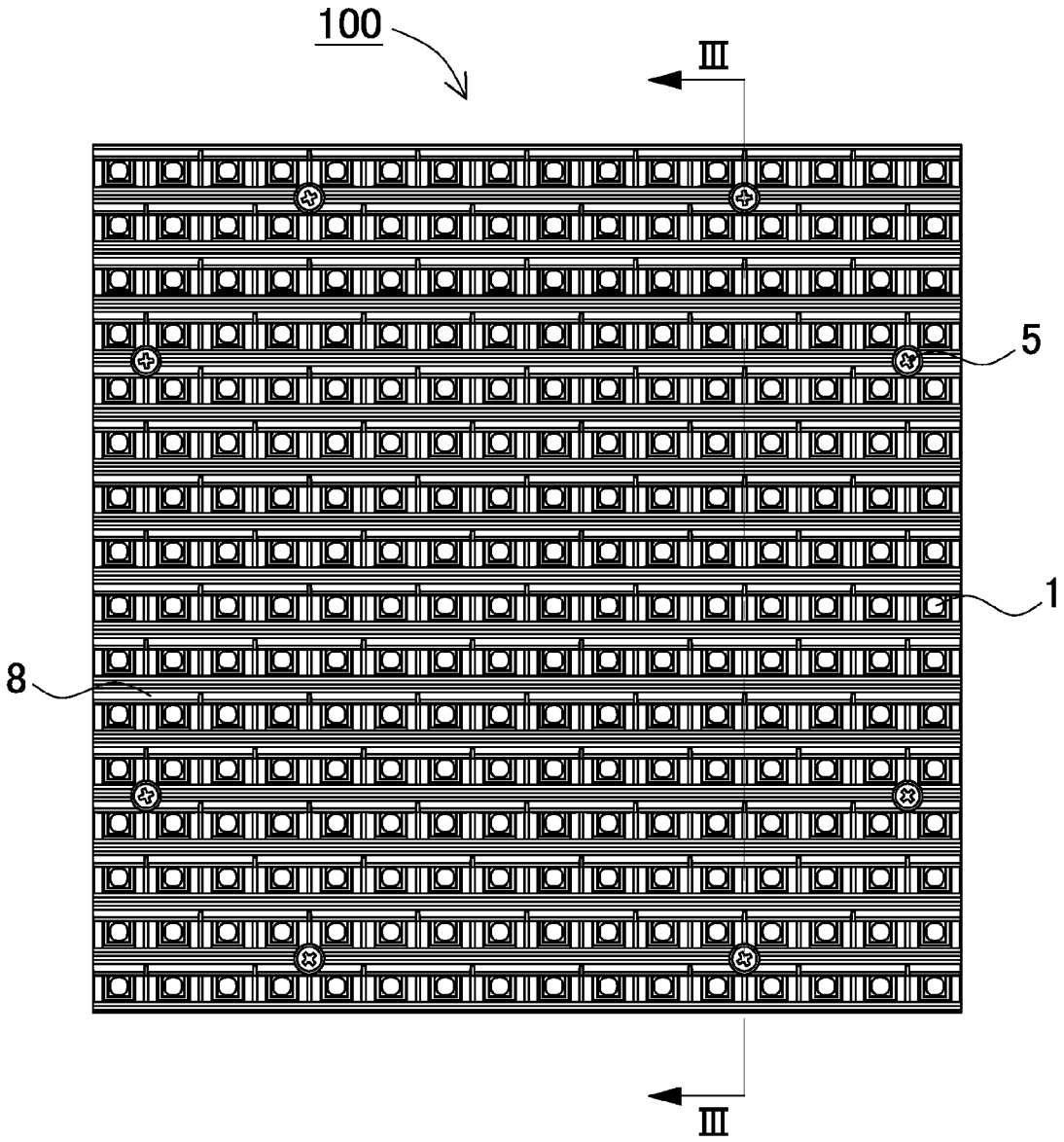
FIG. 2 is a front view of an LED light emitting apparatus according to an embodiment of the present invention.
Figure 3:
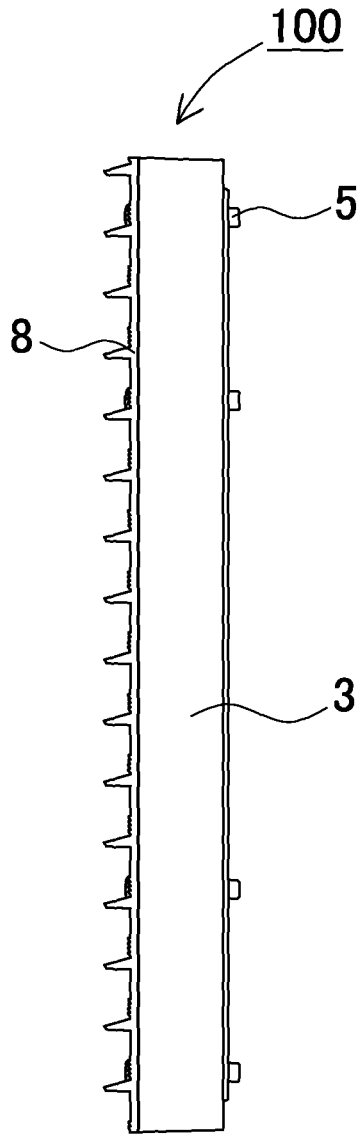
FIG. 3 is a side view of an LED light emitting apparatus according to an embodiment of the present invention.
Figure 4:
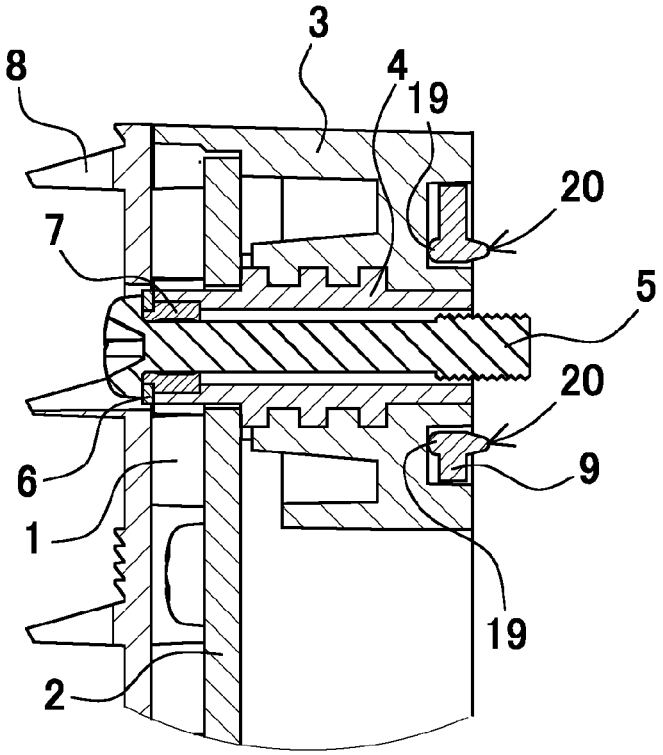
FIG. 4 is a cross-sectional view illustrating a structure around a bolt used in an LED light emitting apparatus according to an embodiment of the present invention.
Figure 5:
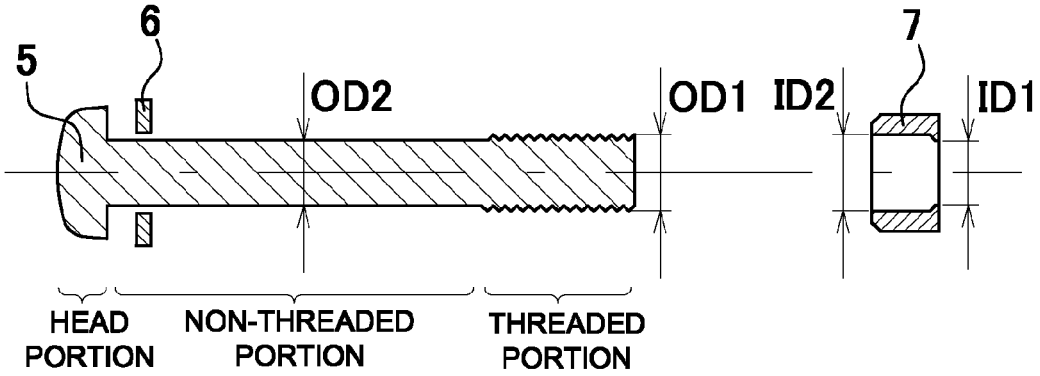
FIG. 5 is a schematic diagram illustrating a bolt and an elastic member used in an LED light emitting apparatus according to an embodiment of the present invention.
Figure 6:
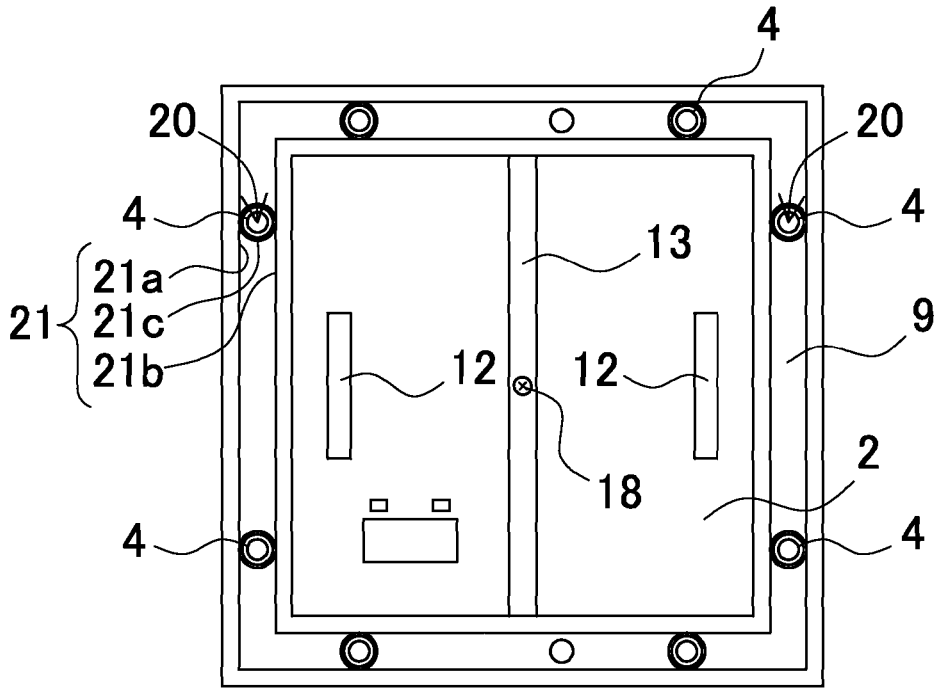
FIG. 6 is a rear view of the LED light emitting apparatus shown in FIG. 2.
Figure 7:
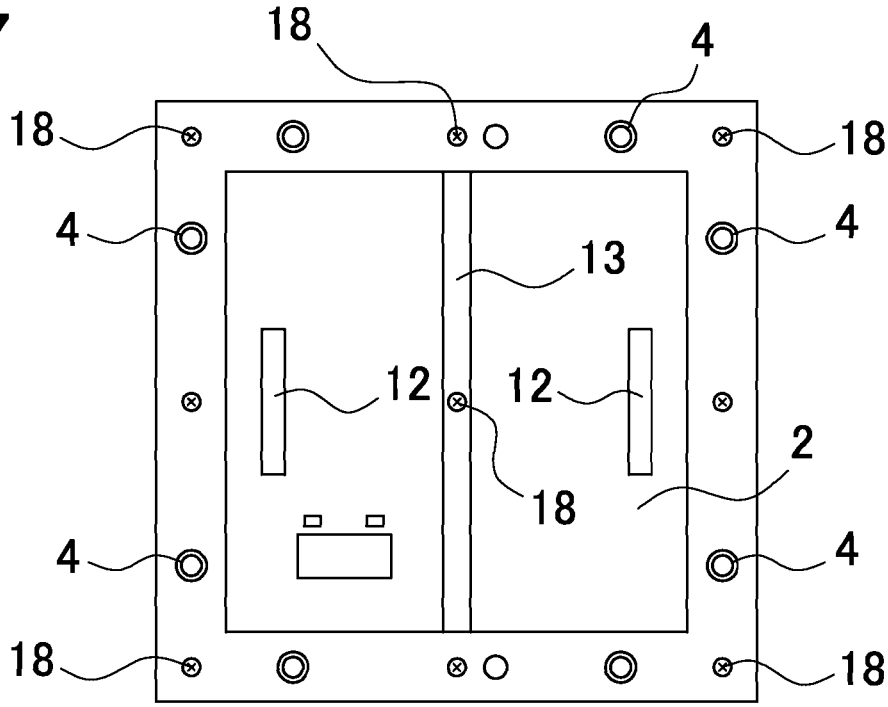
FIG. 7 is a rear view illustrating a state in which the packing is removed from the LED light emitting apparatus shown in FIG. 6.

FIG. 1 shows an exploded view of an LED light emitting apparatus 100 according to an embodiment of the present invention. FIG. 2 is a diagram of the LED light emitting apparatus 100 as seen from a front side, and FIG. 3 is a side view of the LED light emitting apparatus 100 of FIG. 2, as seen from the right side of FIG. 2. FIG. 4 is a partially cross-sectional view taken along dashed line III-III of FIG. 2, illustrating a structure around the bolt 5. FIG. 5 is a schematic diagram illustrating the relationship between the bolt 5 and the elastic member 7. Further, FIG. 6 is a rear view of the LED light emitting apparatus shown in FIG. 2, and FIG. 7 is a rear view illustrating a state in which the packing 9 is removed from the LED light emitting apparatus shown in FIG. 6, respectively.

The LED light emitting apparatus 100 has a plurality of LEDs (light emitting diodes) 1, the case 3 having the LEDs 1 at its front side, and a plurality of bolts 5 each having a threaded portion to fix the case 3 to an outside (see FIG. 1 to FIG. 4). The case 3 has a plurality of insertion portions 4 each allowing insertion of the bolt 5 from the front side through to the back side of the case 3 (see FIG. 1 and FIG. 4). Each of the insertion portions 4 has at its inner portion an elastic member 7 having a first inner diameter ID1 smaller than an outer diameter OD1 of the corresponding threaded portion (see FIG. 4 and FIG. 5). Further, the elastic member 7 is fixed to the insertion portion 4 (see FIG. 4).

With this arrangement, at the time of installation of the LED light emitting apparatus 100 on a side wall of a building etc., or at the time of maintenance thereof, accidental detachment of the bolt 5 from its insertion portion 4 can be prevented, which can prevent accidental physical injury to passersby below. That is, fixing the elastic member 7 having an inner diameter ID1 smaller than an outer diameter of the corresponding threaded portion OD1 to the insertion portion 4 allows the threaded portion pauses at the portion of the inner diameter ID1 at the time when the worker removes the bolt 5. Thus, the worker can operate without completely removing the bolts 5 from the insertion portions 4 at the time of installation and the like, so that working efficiency can be improved. Even in the case of totally removing the bolt 5 from the insertion portion 4, the probability of accidental dropping of the bolt 5 by the worker can be reduced. The main components of the LED light emitting apparatus 100 will be described below.

(LED 1)

The LED light emitting apparatus 100 has a plurality of LEDs 1 as its light source. In the present embodiment, the LEDs 1 of a surface-mount type are used, but a through-hole type can also be used.

(Base Member 2)

The base member 2 is a so-called circuit board for mounting the LEDs 1. For the parent material of the base member 2, glass epoxy or the like can be employed, and in view of heat dissipation efficiency, a material having high heat conductivity such as aluminum may be contained. In the present embodiment, various electric components and the connectors 12 for electric connection are disposed at the back side of the base member 2 so as to operate the LEDs 1. Further, as shown in the perspective view in FIG. 1 or the rear views in FIGS. 6 and 7, the case 3 is formed in a rectangular frame shape and a crosspiece 13 is arranged at approximately the middle of the frame shape. As shown above, reinforcing the case 3 of a frame shape by the crosspiece 13 can improve its mechanical strength. In the case where the connectors 12 disposed on the base member 2 have a rectangular shape, they are fixed approximately in parallel to the crosspiece 13. With this, contacting of the crosspiece 13 and the connectors 12 can be avoided. Further preferably, the crosspiece 13 is designed to be in a vertical orientation when the LED light emitting apparatus 100 is fixed to an outside. The longer the connectors 12, the heavier the plugs to be inserted thereto, so that by their weight, the plugs may easily come out of the connectors 12 or loose electrical connection between the plugs and the connectors 12 may result. Therefore, arranging the connectors 12 in a longitudinal orientation facilitates maintaining the fixing state between the connectors 12 and the plugs, and thus enables to reduce the risk of such loose electrical connection.

A waterproof member may be disposed at the front side of the base member 2. For example, on the front side of the base member 2 where the LEDs 1 are mounted, a fluid silicone resin is applied to fill the interspace between the LEDs 1 and then cured to form a waterproof member. In order to enhance the contrast, the waterproof member is preferably has a dark color such as a black color.

(Case 3 and Insertion Portion 4)

The case 3 supports, at its front side, the base member 1 which has the LEDs 1 disposed thereon. The case 3 has a plurality of insertion portions 4, each passes through the front side to the back side of the case 3 for allowing the bolt 5 to be inserted from the front side of the case 3 to connect and fix the case 3 to an outside. The insertion portion 4 is tightened by the bolts 5 when the LED light emitting apparatus 100 is fixed to the outside. Therefore, the insertion portions 4 are preferably made of a different member than the case 3. More specifically, the case 3 may be formed of a resin such as polycarbonate and the insertion portion 4 may be made of a metal such as brass.

In the case where the case 3 and the insertion portions 4 are made of different materials, the case 3 and the insertion portions 4 are preferably integrally molded (insert molded). With this, waterproofness between the case 3 and the insertion portion 4 can be secured. That is, with the integral molding, the case 3 and the insertion portions 4 can be formed attached to each other, so that waterproof property can be further improved.

(Bolt 5)

The bolts 5 are inserted in the respective insertion portions 4 from the front side of the case 3 to fix the case 3 to a side wall of a building etc. Typically, a fixing plate is disposed on a side wall of a building etc. so that the LED light emitting apparatus 100 can be fixed to an outside by tightening the bolts 5 to the fixing plate. As shown in FIG. 5, such a bolt 5 has, from the front side, a head portion, a non-threaded portion, and a threaded portion. The outer diameter OD2 of the non-threaded portion of the bolts 5 is preferably smaller than the outer diameter OD1 of the threaded portion. The outer diameter of the head portion of the bolts may be 5 mm or less. Particularly, the smaller the bolts, the more difficult to maintain waterproof performance by using conventional sealing washers 6 etc. Therefore, even in an LED light emitting apparatus having a small size and small pitches between the LEDs, waterproof structure can be obtain with a simple construction.

(Washer 6)

As shown in FIG. 5, the bolt 5 may have a washer 6 which is inserted onto the non-threaded portion. The use of washer 6 enables to prevent deformation of the elastic member 7 due to friction between the elastic member 7 and the head portion of the bolt 5 at the time of tightening the bolt 5. The outer diameter of the washer 6 is made slightly larger than the diameter of the bolt 5. Meanwhile, the outer diameter of the washer 6 is, however, preferably substantially the same as the outer diameter of the front-side end of the insertion portions 4. With this arrangement, after fixing the LED light emitting apparatus 100, the front-side ends are respectively covered with the washers 6, so that the insertion portions 4 can be prevented from being exposed to the outside. The insertion portions 4 are made of a metal such as brass. Meanwhile, the case 3 is typically colored such as a black to improve the contrast. Therefore, without further treatment, the front-side ends with the metallic color are exposed partially on the black surface of the case, which may result in poor appearance. For this reason, the front-side end of the insertion portions 4 are covered with the washers 6 so as not to be exposed at the front side of the case 3, and thus, the outer appearance of the LED light emitting apparatus in front view can be improved. On the other hand, at the time of fixing the LED light emitting apparatus to a fixing surface at an outside, better workability can be achieved when the positions to insert the bolts 5 are easily recognized. Thus, the coloring of the insertion portions 4 in a black color to avoid exposing of the metal color of the front-side end of the insertion portions 4 may hamper the operation of visually recognizing the insertion portions at the time of fixing the bolts 5. For this reason, as described above, applying a different color than the case 3 to the front-side end of the insertion portions 4 (for example, the in-situ color of brass) enables to facilitate visual recognition of the engaging positions of the bolts and thus improve the workability. Also, after fixing, the front-side end of the insertion portions 4 are covered with the respective washers 6, which enables to prevent the color of the front-side ends from standing out.

(Elastic Member 7)

The elastic member 7 is, for example, made of a rubber such as a silicone rubber, and at least a part of the elastic member 7 is fixed to the inner side of the hole of the insertion portions 4. Fixing of the elastic member 7 to the insertion portions 4 may be carried out, for example, by using an adhesive agent or by way of integral molding. While the insertion portions 4 are for tightening the bolts 5, the elastic member 7 is for preventing the bolts 5 from dropping. Therefore, the insertion portions 4 and the elastic member 7 are preferably made of different materials.

As shown in FIG. 5, the elastic member 7 may have at its front side a second inner diameter ID2 larger than a first inner diameter ID1. This facilitates insertion of the bolts 5 from the front side and thus the working efficiency can be improved. That is, the elastic member 7 may have substantially a cylindrical shape to allow insertion of the bolt 5, with the second inner diameter ID2 at the front side and the first inner diameter ID1 at the back side. Particularly, in the inserting direction of the bolt 5, the region having the first inner diameter ID1 is preferably smaller than the region having the second inner diameter ID2. With this arrangement, at the time of inserting the bolt 5 through the elastic member 7, the bolt 5 can be prevented from becoming hard to move due to the friction between its threaded portion and a portion of the elastic member 7 with the first inner diameter of ID1, so that the working efficiency can be improved.

As shown in FIG. 5, the second inner diameter ID2 of the elastic member 7 can be larger than the outer diameter OD2 of the non-threaded portion. With this arrangement, at the time of inserting the bolt 5 through the elastic member 7, the bolt 5 can be prevented from becoming hard to move due to the friction between its non-threaded portion and a portion of the elastic member 7 with the second inner diameter of ID2, so that the working efficiency can be improved.

A part of the elastic member 7 can be formed protruded from the front side of the insertion portion 4. By compressing the protruded portion directly or indirectly with the head portion of the bolt 5, the bolt 5 and the elastic member 7 can be tightly contacted with each other. Thus, waterproofness between the bolt 5 and the elastic member 7 can be achieved.

The first inner diameter ID1 of the elastic member 7 can be smaller than the second outer diameter OD2 of the non-threaded portion, to the extent that the movement of the bolt 5 is not disturbed. With this arrangement, waterproof function can be obtained even at the back side of the elastic member 7.

The insertion member 4 and the elastic member 7 are preferably integrally molded. With this, waterproofness between the insertion member 4 and the elastic member 7 can be further secured.

In a state where the bolt 5 has not been tightened, the elastic member 7 which is protruded from the front side of the insertion portion 4 has a slope portion inclining from the inner side outwardly to the back side, and the washer 6 can be arranged so that the inner circumference of the washer 6 comes in contact with the slope portion. With this, the positional relationship between the washer 6 and the elastic member 7 can be stabilized, so that waterproof function can be more securely obtained.

(Light Blocking Member 8)

A light blocking member 8 may be disposed at the front side of the base member 2. The light blocking member 8 prevents external light such as sunlight from irradiating the LEDs 1 and their vicinity, and thus, contrast can be improved. In the LED light emitting apparatus 100, as shown in FIG. 1 and FIG. 7, the light blocking member 8 is fixed from the back side of the case 3 by using a plurality of light blocking member fixing bolts 18. With this arrangement, the light blocking member fixing bolts 18 can be installed so as not to be exposed at the front side, so that the LED light emitting apparatus with excellent appearance can be obtained. Also, the fixing positions of the light blocking member fixing bolts 18 are arranged so as not to interfere with the positions of the insertion portions 4 on the case 3. The insertion portions 4 are, in the examples shown in the perspective view in FIG. 1 and the rear view in FIG. 6, arranged in an octangular shape at the back side of the case 3. As in the case above, when the insertion portions 4 are arranged at point symmetrical positions on the case, the case may be fixed in a vertically and horizontally reverse orientation. Therefore, in order to fix the LED light emitting apparatus 100 with a predetermined orientation, protrusions for positioning are preferably disposed at asymmetric positions at the back side of the case 3. In the example shown in FIG. 6, two positioning protrusions are disposed at an upper and a lower position respectively on a right side with respect to the center line of the back side of the case 3. In addition, at the fixing surface for the LED light emitting apparatus 100, insertion holes are prepared at the positions corresponding to the positioning protrusions. Thus, the orientation and position of the LED light emitting apparatus 100 are determined, and fixing with an incorrect orientation can be avoided.

(Packing 9)

A packing 9 may be disposed at the backside of the case 3. Disposing the packing 9 at the external peripheral portion of the back side of the case enables to provide water tightness between the case 3 and the outside fixing surface. The packing 9 may be made of an elastic material such as rubber. The outer shape of the packing 9 is formed, as shown in the exploded perspective view in FIG. 1, in a frame-shape with a rectangular opening at its center along the back side of the frame-shaped case 3 to cover it. Preferably, a recessed portion is formed in the back side of the case 3 to install the packing 9. With this arrangement, the packing 9 can be positioned and fixed to the back side of the case 3. Particularly, by forming the packing 9 slightly larger than the size of the recessed portion, the packing 9 can be elastically deformed to be fit in the recessed portion and is fixed to the case 3. Openings 20 are formed in the portions in the surface of the pacing 9 in contact with the case 3 where the insertion portions 4 are formed to allow the bolts 5 to pass through. As shown in the exploded perspective view in FIG. 1 and the cross sectional view in FIG. 4, a first rib 19 is formed on the packing 9 so as to be protruded on the joining surface with the case 3. The first rib 19*a* is arranged on the packing 9 at slightly inner side along the outer circumference of the packing 9 in an enclosing manner. With this arrangement, the packing 9 is pressed to the backside of the case 3 so that the tip of the first rib 19*a* is elastically deformed to fill the gaps between the packing 9 and the case 3 and thus waterproof property is achieved. More preferably, as shown in the exploded perspective view in FIG. 1, in addition to the first rib 19*a* formed at the outer circumference side of the packing 9, another first rib 19*b* is also formed at the inner circumference side of the packing 9. As described above, forming a pair of first ribs 19*a*, 19*b* enables to increase the waterproofing ability. In addition, at the portions establishing respective apertures 20 for the respective insertion portions 4, ribs 19*c* for apertures are formed to surround the respective apertures so as to avoid ingress of water from the insertion portions 4. As shown in the partially enlarged view in FIG. 1, the ribs 19*c* for apertures are formed in an annular shape between, and in contact with the corresponding first ribs 19*a* and 19*b*. Thus, connecting the corresponding first ribs 19*a* and 19*b* and the rib 19*c* for aperture enables to avoid ingress of water effectively. The ribs are formed on the packing 9 not only on the joining surface to the case 3 but also, as shown in the rear view in FIG. 6, on the joining surface to the external fixing surface, the second ribs 21 are formed protruded toward the outside fixing surface. In the same manner as in the first ribs 19, the second ribs 21 are preferably formed such that, in addition to the second rib 21*a* at the outer circumference side of the packing 9, the second rib 21*b* is formed at the inner circumference side of the packing 9, and the ribs 21*c* for apertures are formed surrounding the respective apertures 20. Thus, not only placing the packing 9 between the case 3 and the outside fixing surface but also forming the ribs 19 and 21 protruding from the respective surfaces enables to achieve more reliable waterproof performance.

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims. The present application is based on Application No. 2011-184,215 filed in Japan on Aug. 26, 2011, the content of which is incorporated herein by reference.

What is claimed is:

1. An LED light emitting apparatus comprising:

a plurality of LEDs;

a case provided with the LEDs at a front side; and a plurality of bolts each having a threaded portion for screwing the case to an outside, wherein the case has a plurality of insertion portions each allowing insertion of the bolt from the front side through to a back side of the case, wherein each of the plurality of insertion portions has an elastic member having a first inner diameter which is smaller than an outer diameter of the threaded portion, and wherein the elastic member is fixed to the insertion portion.

2. The LED light emitting apparatus according to claim 1, wherein the elastic member has a second inner diameter, which is larger than the first inner diameter, at the front side.

3. The LED light emitting apparatus according to claim 2, wherein each of the plurality of bolts has a head portion, a non-threaded portion, and the threaded portion in this order from the front side, and the second inner diameter of the elastic member is larger than the outer diameter of the non-threaded portion.

4. The LED light emitting apparatus according to claim 3, wherein a part of the elastic member is protruded from the front side of the insertion portion, which allows the head portion directly or indirectly compressing the elastic member protruded from the insertion portion, which allows the bolt and the elastic member tightly contacting with each other.

5. The LED light emitting apparatus according to claim 1, wherein the plurality of insertion portions are made of a member different than a member which forms the case, and are integrally made with the case.

6. The LED light emitting apparatus according to claim 1, wherein the elastic member is made of a different member than a member which forms the insertion portion, and is integrally made with the insertion portion.

7. The LED apparatus according to claim 3, wherein each bolt has a washer inserted in the non-threaded portion, the elastic member protruded from the front side of the insertion portion has a slope portion inclining from the inner side outwardly to the back side, and the inner circumference of the washer can be in contact with the slope portion.

8. The LED light emitting apparatus according to claim 7, wherein an outer diameter of the washer is substantially equal to an outer diameter of the front-side end of the plurality of the insertion portions.

9. The LED light emitting apparatus according to claim 8, wherein the front-side end of the plurality of the insertion portions have a different color than the case.

10. The LED light emitting apparatus according to claim 9, wherein the washer has substantially the same color as the case.

11. The LED light emitting apparatus according to claim 1, wherein the case is made of a resin and the plurality of the insertion portions are made of a metal.

12. The LED light emitting apparatus according to claim 1 further comprising a light-blocking member on the front side of a base member, wherein the light-blocking member is fixed through a plurality of light blocking member fixing bolts from the back side of the case.

13. The LED light emitting apparatus according to claim 12 wherein the light blocking member fixing bolts are arranged on the case at positions different than the insertion portions.

14. The LED light emitting apparatus according to claim 1, further comprising a plurality of positioning protrusions disposed asymmetrically on the back side of the case.

15. The LED light emitting apparatus according to claim 1, wherein the insertion portions are arranged in an octangular shape on the case.

16. The LED light emitting apparatus according to claim 1, wherein the case is formed in a frame shape and a crosspiece is arranged at approximately the middle of the frame shape, and on the base member, at least one connector for electric connection is fixed approximately parallel to the crosspiece.

17. The LED light emitting apparatus according to claim 16, wherein at the time of fixing the LED light emitting apparatus to an outside, the crosspiece is fixed in a vertical orientation.

18. The LED light emitting apparatus according to claim 1, wherein an outer diameter of the head portion of the bolts may be 5 mm or less.

* * * * *